US008947848B2

(12) United States Patent
Musial et al.

(10) Patent No.: US 8,947,848 B2
(45) Date of Patent: Feb. 3, 2015

(54) SMARTER HEALTH CONSCIOUS ELECTROSHOCK DEVICE WITH MEDICAL IMPLANT DETECTION

(75) Inventors: John G. Musial, Newburgh, NY (US); Abhinay R. Nagpal, Pune (IN); Sandeep R. Patil, Somers, NY (US); Dhaval K. Shah, Nadiad (IN)

(73) Assignee: International Business Machines Corporation, Armonk, NY (US)

( * ) Notice: Subject to any disclaimer, the term of this patent is extended or adjusted under 35 U.S.C. 154(b) by 916 days.

(21) Appl. No.: 13/023,234

(22) Filed: Feb. 8, 2011

(65) Prior Publication Data

US 2012/0202604 A1 Aug. 9, 2012

(51) Int. Cl.
*F41B 15/04* (2006.01)
*F41H 13/00* (2006.01)

(52) U.S. Cl.
CPC ..... *F41H 13/0012* (2013.01)
USPC ..... 361/232

(58) Field of Classification Search
USPC ..... 307/232; 463/47.3; 361/232; 600/300
See application file for complete search history.

(56) References Cited

U.S. PATENT DOCUMENTS

| | | | | |
|---|---|---|---|---|
| 4,550,370 | A | 10/1985 | Baker | |
| 4,556,063 | A | 12/1985 | Thompson et al. | |
| 4,676,248 | A | 6/1987 | Berntson | |
| 4,884,809 | A * | 12/1989 | Rowan | 463/47.3 |
| 5,292,343 | A | 3/1994 | Blanchette et al. | |
| 6,292,692 | B1 * | 9/2001 | Skelton et al. | 607/5 |
| 6,416,471 | B1 * | 7/2002 | Kumar et al. | 600/300 |
| 6,898,887 | B1 * | 5/2005 | Stratbucker | 42/1.08 |
| 7,152,990 | B2 | 12/2006 | Kukuk | |
| 7,305,787 | B1 | 12/2007 | Stratbucker | |
| 7,524,076 | B2 | 4/2009 | Kukuk | |
| 2007/0028501 | A1 | 2/2007 | Fressola et al. | |
| 2007/0282181 | A1 * | 12/2007 | Findlay et al. | 600/323 |
| 2008/0004663 | A1 * | 1/2008 | Jorgenson | 607/5 |
| 2008/0204965 | A1 | 8/2008 | Brundula et al. | |
| 2009/0043354 | A1 | 2/2009 | Ricke | |
| 2010/0164680 | A1 * | 7/2010 | Yancey et al. | 340/5.32 |
| 2012/0190969 | A1 * | 7/2012 | Kameli | 600/424 |

OTHER PUBLICATIONS

Furse, Cynthia, "Design an Antenna for Pacemaker Communication", Microwaves & RF, Mar. 2000, pp. 73-76.

* cited by examiner

*Primary Examiner* — Jared Fureman
*Assistant Examiner* — Joseph Inge
(74) *Attorney, Agent, or Firm* — Cahn & Samuels, LLP

(57) ABSTRACT

An embodiment of the invention includes a device including at least one probe for delivering an electrical shock to a subject when the probe is in physical contact with the subject. A power source is connected to the probe for providing electrical power to the probe upon actuation of a trigger. The device further includes a medical device sensor for detecting signals emitted from a medical device present in the subject. In at least one embodiment, an alarm is connected to the medical device sensor, wherein the alarm provides an audio and/or a visual alert when the medical device sensor detects signals emitted from the medical device. In at least one embodiment, an override mechanism is connected to the medical device sensor, wherein the override mechanism prevents actuation of the trigger when the medical device sensor detects signals emitted from the medical device.

21 Claims, 5 Drawing Sheets

SMARTER HEALTH CONSCIOUS ELECTROSHOCK DEVICE WITH MEDICAL IMPLANT DETECTION

BACKGROUND

The present invention is in the field of devices, systems, methods, and computer program products for a smarter health conscious electroshock device with medical implant detection.

In an effort to reduce the number of fatalities and serious injury caused by ballistic firearms, electroshock devices (also known as "stun guns") are commonly used by law enforcement personnel to subdue subjects. In addition to law enforcement personnel, electroshock devices are also used by corrections officers, transportation security officers, private security, and the military as a less-lethal means for incapacitating a hostile subject.

SUMMARY OF THE INVENTION

An embodiment of the invention includes a smarter health conscious electroshock device with medical implant detection. More specifically, the device includes at least one probe for delivering an electrical shock to a subject when the probe is in physical contact with the subject. A power source is connected to the probe for providing electrical power to the probe upon actuation of a trigger. The device further includes a medical device sensor for detecting signals emitted from a medical device present in the subject.

In at least one embodiment, controller is connected to the medical device sensor and an alarm, an override mechanism, and/or an indicator. The alarm is connected to the medical device sensor, wherein the alarm provides an audio and/or a visual alert when the medical device sensor detects signals emitted from the medical device. The override mechanism is connected to the medical device sensor, wherein the override mechanism prevents actuation of the trigger when the medical device sensor detects signals emitted from the medical device. The indicator is also connected to the medical device sensor, wherein the indicator provides an audio and/or a visual indication when the medical device sensor does not detect signals emitted from a medical device.

In at least one embodiment, the device includes a transmitter connected to the medical device sensor and/or a biometric sensor. The biometric sensor identifies the identity of the subject and includes a facial recognition system, retinal scanner, and/or fingerprint scanner. The transmitter sends output from the medical device sensor and/or biometric sensor to a remote repository, wherein the remote repository includes a database of signals produced by medical devices, an implant registration database, and/or a medical records database. A receiver is connected to the controller, wherein the receiver receives an indication that a match has been found in the remote repository or an indication that a match has not been found in the remote repository. Additionally, the device includes a storage device connected to the medical device sensor, wherein the storage device includes a database of signals produced by medical devices and an implant registration database.

Another embodiment of the invention provides a method for using an electroshock device. More specifically, a subject is scanned for signals emitted from a medical device with a medical device sensor of the electroshock device. When the medical device sensor of the electroshock device detects signals emitted from a medical device, an alarm of the electroshock device is activated and/or a trigger, a power source, and/or a probe of the electroshock device is deactivated. When the medical device sensor of the electroshock device does not detect signals emitted from a medical device, an indicator on the electroshock device is activated. When the medical device sensor of the electroshock device does not detect signals emitted from a medical device, electrical power is provided to the probe upon actuation of the trigger.

In at least one embodiment, output from the medical device sensor is sent to a remote repository, wherein the remote repository includes a database of signals produced by medical devices. An indication that a match has been found in the remote repository or an indication that a match has not been found in the remote repository is received. In at least one embodiment, output from the medical device sensor is sent to a storage device of the electroshock device, wherein the storage device includes a database of signals produced by medical devices. An indication that a match has been found in the storage device or an indication that a match has not been found in the storage device is received.

In at least one embodiment, the subject is scanned with a biometric sensor to identify an identity of the subject. The identity of the subject is sent to a remote repository outside of the electroshock device, wherein the remote repository includes an implant registration database and/or a medical records database. An indication that a match has been found in the remote repository or an indication that a match has not been found in the remote repository is received. In at least one embodiment, the identity of the subject is sent to a storage device in the electroshock device, wherein the storage device includes an implant registration database and/or a medical records database. An indication that a match has been found in the storage device or an indication that a match has not been found in the storage device is received. When the subject is listed in the implant registration database and/or the medical records database indicates that the subject has a history of cardiac problems, the alarm of the electroshock device is activated and/or the trigger, the power source, and/or the probe of the electroshock device is deactivated.

BRIEF DESCRIPTION OF THE SEVERAL VIEWS OF THE DRAWINGS

The present invention is described with reference to the accompanying drawings. In the drawings, like reference numbers indicate identical or functionally similar elements.

DETAILED DESCRIPTION

Figure 1A:
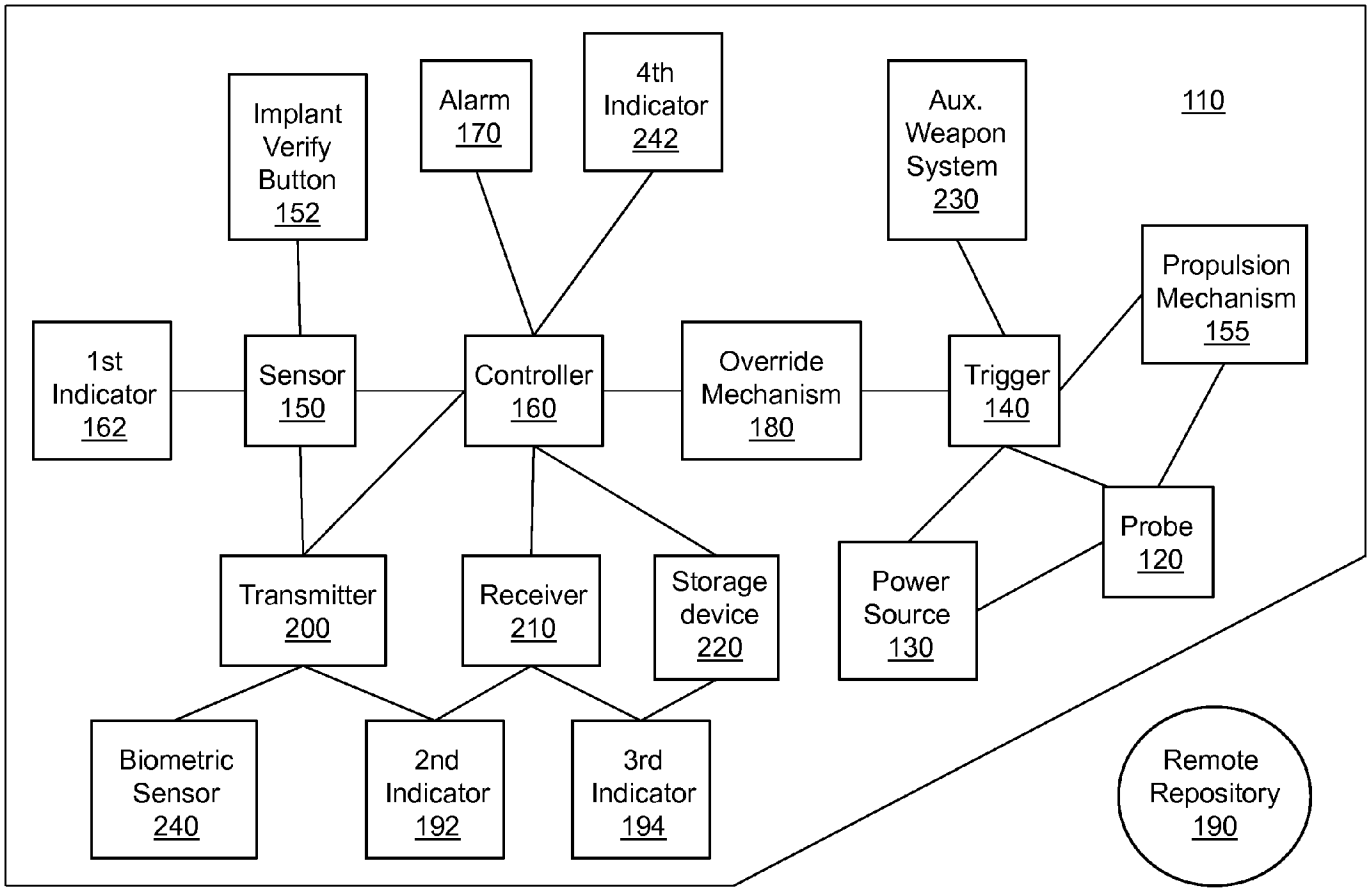
FIG. 1A is a block diagram illustrating a system for a smarter health conscious electroshock device according to an embodiment of the invention.

Exemplary, non-limiting, embodiments of the present invention are discussed in detail below. While specific configurations are discussed to provide a clear understanding, it should be understood that the disclosed configurations are provided for illustration purposes only. A person of ordinary skill in the art will recognize that other configurations may be used without departing from the spirit and scope of the invention.

An embodiment of the invention provides a smart electroshock device having the ability to detect implanted medical devices (e.g., pacemakers, defibrillators) and alert the user with a visual and/or audio alarm. Thus, a law enforcement officer or other user is warned of the risks involved and given the option to employ a safer means for subduing a subject, thereby reducing the number of fatalities, risk of serious injury, and potential liability associated with the use of an electroshock device.

In at least one embodiment, the smart electroshock device includes an "Implant Verify" button. In order to determine whether a subject has an implanted medical device, the user points the smart electroshock device at the subject and actuates the "Implant Verify" button. When the subject has an implanted medical device, the smart electroshock device detects a signal emitted from the implanted medical device and/or connects with an available communication channel. In another embodiment, the smart electroshock device automatically scans for the presence of an implanted medical device when the smart electroshock device is unholstered, when power to the smart electroshock device is turned on, and/or when an implant sensor of the smart electroshock device (also referred to herein as the "sensor") is turned on. In yet another embodiment, the smart electroshock device automatically scans for the presence of an implanted medical device when a trigger to deliver the electrical shock and/or propel a probe of the smart electroshock device is actuated.

In at least one embodiment of the invention, the smart electroshock device is equipped with a visual alert component (e.g., one or more LEDs), an audio alert component (e.g., one or more sound speakers), and/or an alternative less-lethal restraint option (e.g., pepper spray, rubber bullets). Thus, the user is given the opportunity to either use a less-lethal restraint option or make an informed decision to subdue the subject with an electrical shock.

In another embodiment, the smart electroshock device has the ability to identify the subject using biometric technology, such as facial recognition. Having the subject's identity, the smart electroshock device can connect to an implant registration database, which lists individuals having medical implants. In another embodiment, the smart electroshock device connects to a remote database to access the subject's medical history to determine when the person has a weak heart or other cardiac problems. This can help to avoid circumstances where the subject is merely carrying a medical device (that is not physically implanted) in an attempt to deceive the safety precautions of the smart electroshock device. In at least one embodiment, access to the database(s) is restricted to government agencies and other authorized personnel (e.g., law enforcement, transportation security) in order to respect the subject's privacy.

Figure 1B:
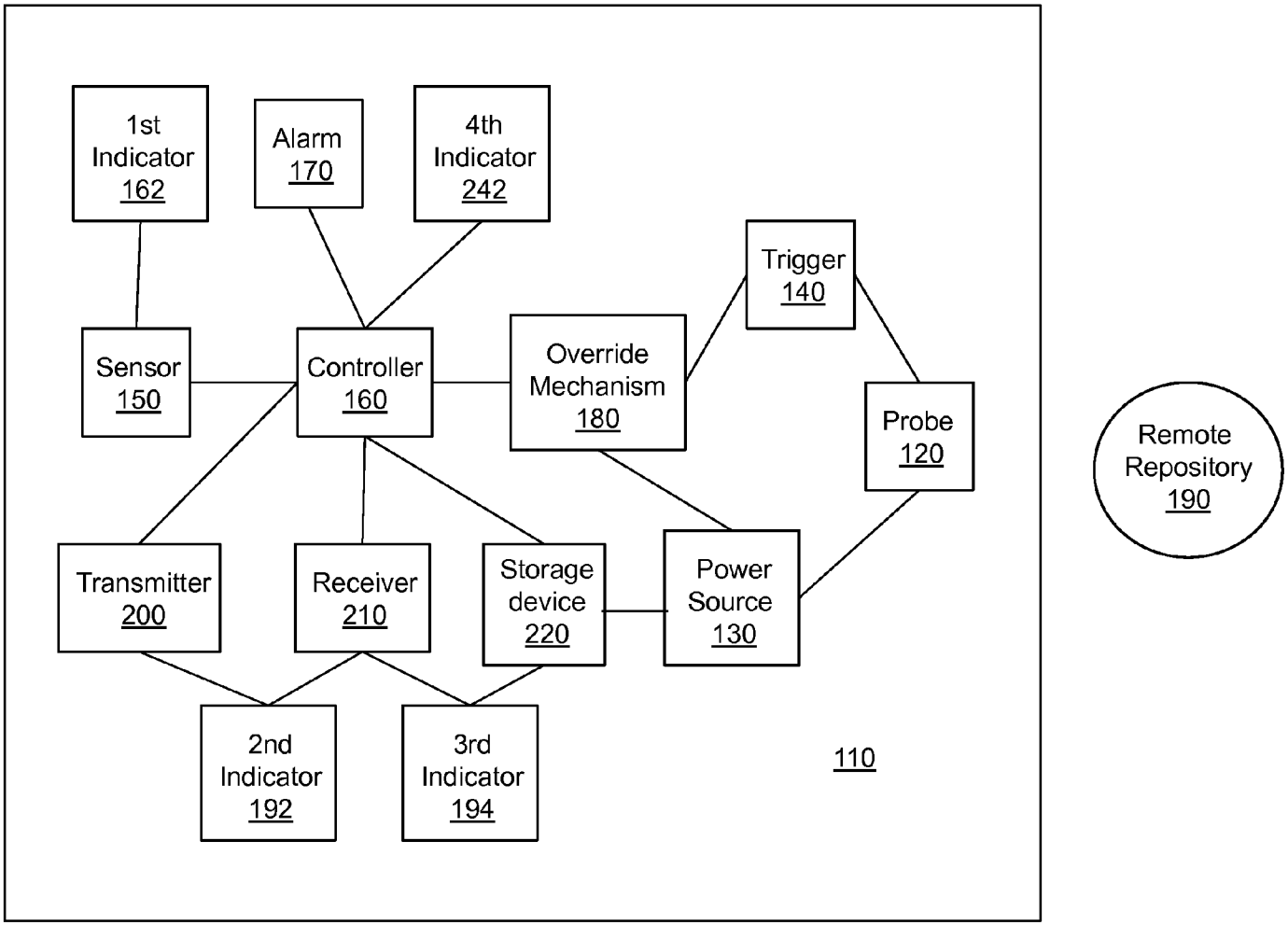
FIG. 1B is a block diagram illustrating a system for a smarter health conscious electroshock device according to another embodiment of the invention.

FIG. 1A is a block diagram illustrating a system 100 according to an embodiment of the invention. The system 100 includes a device 110 (also referred to herein as the "smart electroshock device") having at least one probe 120, a power source 130, a trigger 140, and a sensor 150. Although FIG. 1A illustrates the components of the system 100 in a particular configuration, other embodiments of the invention include different configurations and different arrangements of connections between components. For example, FIG. 1B is a block diagram illustrating a system for a smarter health conscious electroshock device according to another embodiment of the invention.

The probe 120 delivers an electrical shock to a subject when the probe 120 is in physical contact with the subject. The power source 130 provides electrical power to the probe 120 upon actuation of the trigger 140. In at least one embodiment, the power source 130 also provides electrical power to other components of the device 110 (e.g., the sensor 150). In another embodiment, the power source 130 only provides electrical power to the probe 120. In at least one embodiment, the device 110 further includes a propulsion mechanism 155 for propelling the probe 120 from the device 110 upon actuation of the trigger 140, wherein the probe 120 is tethered to the device 110.

As described above, the sensor 150 detects signals emitted from a medical device upon actuation of an "Implant Verify" (or similarly labeled) button 152. In another embodiment, the device 110 automatically verifies the presence of an implanted medical device when the device 110 is unholstered, when power to the device 110 is turned on, when a separate power switch to the sensor 150 is turned on, and/or when the trigger 140 is actuated. As used herein, the term "signals" refers to electrical waves, pulses, and/or current emitted from a medical device.

In at least one embodiment, in order to detect a signal emitted from an implanted medical device, the sensor 150 must be in close proximity or in physical contact with the subject. Thus, in one embodiment, all or part of the sensor 150 is connected to the probe 120. As used herein, the term "connected" is intended to mean operationally connected, in communication with, physically connected, engaged, coupled, contacts, linked, affixed, and attached.

In at least one embodiment of the invention, the device 110 further includes a controller 160 connected to the sensor 150. The controller 160 is also connected to an alarm 170 and/or an override mechanism 180. The alarm 170 includes an audio component (e.g., speakers) and/or a visual component (e.g., LED) that is activated by the controller 160 in response to output of the sensor 150. The override mechanism 180 is connected to the controller 160 and the trigger 140. When the sensor 150 detects signals emitted from a medical device, the override mechanism 180 prevents mechanical and/or electrical actuation of the trigger 140. In another embodiment, the override mechanism 180 is connected to the power source 130, the probe 120, and/or the propulsion mechanism 155, wherein activation of the override mechanism 180 by the controller 160 deactivates the power source 130, the probe 120, and/or the propulsion mechanism 155. In yet another embodiment, the device 110 lacks a controller, wherein the sensor 150 is directly connected to the alarm 170 and/or the override mechanism 180.

In at least one embodiment of the invention, the device 110 further includes a first indicator 162 connected to the sensor 150, wherein the first indicator 162 provides a visual indication (e.g., LED) and/or an audio indication (e.g., tone, chime, or bell) different from the audio alarm component and visual alarm component, respectively, when the sensor 150 does not detect a signal emitted from a medical device. In at least one embodiment, when the sensor 150 is activated (e.g., via actuation of the "Verify Implant" button), the sensor 150 performs a continuous scan for signals, i.e., the sensor 150 is always actively searching for signals. In this embodiment, the first indicator 162 is activated until a signal is detected. In another embodiment, the sensor 150 only performs a single scan when the sensor 150 is activated (e.g., via actuation of the trigger 140), wherein the first indicator 162 is activated when the scan is complete and a signal was not detected. In at least one embodiment, the device 110 includes a "Reset" button to clear the first indicator 162. In yet another embodiment, the sensor 150 automatically performs multiple scans at predetermined time intervals (e.g., every 60 seconds) when the sensor 150 is activated (e.g., when the device 110 is turned on), wherein the first indicator 162 is activated after each scan is complete and when a signal is not detected.

In at least one embodiment of the invention, the system 100 further includes a remote repository 190 that includes a database of known signals produced by medical devices. In such an embodiment, the device 110 further includes a transmitter 200 and a receiver 210, wherein the transmitter 200 is connected to the controller 160 and/or the sensor 150. The transmitter 200 is in wireless communication with the remote repository 190, and sends output (also referred to herein as "first data") from the sensor 150 to the remote repository 190. The receiver 210 is connected to the controller 160, the alarm 170, and/or the override mechanism 180, wherein the receiver 210 receives second data from the remote repository 190.

For example, the sensor 150 detects the presence of a signal emitted from an implanted medical device and sends output to the controller 160, e.g., properties of the detected signal, such as frequency, amplitude, wavelength, and/or other signature characteristics. The controller 160 sends the output to the transmitter 200, which transmits the output to the remote repository 190. The remote repository 190 searches the database of known signals produced by medical devices and transmits the second data back to the receiver 210. When the second data indicates that a match has been found between the output of the sensor 150 and a record in the database, then the controller 160 activates the alarm 170 and/or the override mechanism 180.

In at least one embodiment, communication between the device 110 and the remote repository 190 is transparent to the user. In another embodiment, the device 110 includes a second indicator 192 that provides an audio and/or visual notification to the user that the transmitter 200 and/or receiver 210 is active and/or data has been sent and/or received by the device 110 (e.g., red LED). In yet another embodiment, the device 110 includes a third indicator 194 that provides an audio and/or visual notification to the user that a match was not found between the output of the sensor 150 and the database of known signals produced by medical devices (e.g., a liquid crystal display (LCD) indicating "Low Risk" or "No Match Found").

In another embodiment of the invention, the device 110 includes a storage device 220 having a database of signals produced by medical devices. In one embodiment, the output of the sensor 150 is sent from the controller 160 to the storage device 220. When a match is found between the output of the sensor 150 and a record in the database of the storage device 220, then the controller 160 activates the alarm 170 and/or the override mechanism 180. In at least one embodiment, the third indicator 192 provides an audio and/or visual notification to the user that a match was not found between the output of the sensor 150 and the database of known signals produced by medical devices (e.g., green LED).

In another embodiment of the invention, the device 110 includes an auxiliary lower health risk weapon system 230. For example, the device 110 includes pepper spray, tear gas, rubber bullets, and/or bean bag projectiles. In yet another embodiment of the invention, the device 110 includes a biometric sensor 240 for identifying the identity of the subject. In one embodiment, the biometric sensor 240 includes a facial recognition system, retinal scanner, and/or fingerprint scanner.

In at least one embodiment, the remote repository 190 and/or the storage device 220 includes an implant registration database and/or a medical records database. Thus, the device 110 can cross-reference the identity of the subject with the remote repository 190 and/or the storage device 220. For instance, the biometric sensor 240 is connected to the transmitter 200; and, the transmitter 200 sends output (i.e., first data) from the biometric sensor 240 to the remote repository 190. The remote repository 190 searches the database(s) for the first data. The remote repository 190 sends second data to the receiver 210 indicating whether a match is found.

For example, having identified the subject as John Doe, the biometric sensor 240 sends output to the controller 160, which relays the output to the remote repository 190. The remote repository 190 has John Doe's medical records, which indicate that John Doe has a history of cardiac problems. The remote repository 190 notifies the controller 160 by sending second data to the receiver 210; and, the controller 160 activates the alarm 170 and/or the override mechanism 180. In another example, the remote repository 190 notifies the controller 160 that John Doe's medical records show no indication of prior cardiac problems; and, the controller 160 activates a fourth indicator 242 on the device 110 (e.g., LED labeled "Low Risk"). In yet another example, John Doe's medical records (i.e., second data) are sent to the receiver 210 for analysis by the controller 160.

In another example, the biometric sensor 240 identifies the subject as Jane Doe and sends output (i.e., first data) to the storage device 220. The storage device 220 searches the implant registration database for Jane Doe. When Jane Doe is listed in the implant registration database, the storage device 220 notifies the controller 160 (i.e., sends second data), which activates the alarm 170 and/or the override mechanism 180. When Jane Doe is not listed in the implant registration database, the storage device 220 notifies the controller 160 (i.e., sends second data), which activates a fifth indicator 244 on the device 110 (e.g., green LED). In at least one embodiment of the invention, the device 110 lacks the first indicator 162, second indicator 192, third indicator 194, fourth indicator 242, and, fifth indicator 244, wherein the device 110 includes a single display (e.g., LCD screen) that notifies the user that the sensor 150 has not detected a signal, that the transmitter 200 and/or receiver 210 is active, that first or second data has been sent or received by the device 110, that no match is found between the detected signal and the database of known signals produced by medical devices, that medical records do not show a history of cardiac problems, and/or that no match is found between the output of the biometric sensor 240 and the implant registry database.

Figure 2A:
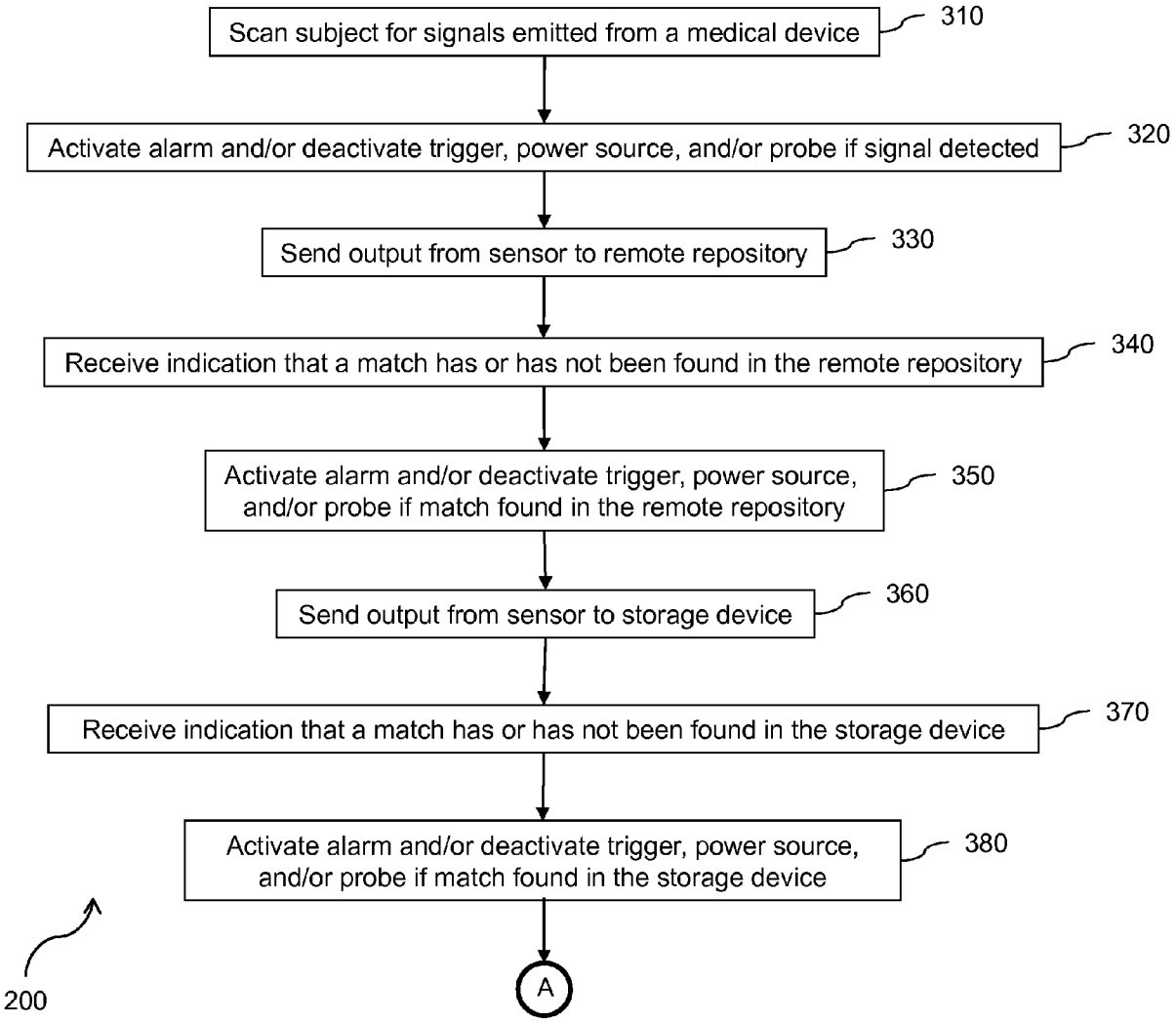
FIGS. 2A and 2B illustrate a flow diagram of a method of using a smart electroshock device according to an embodiment of the invention.
Figure 2B:
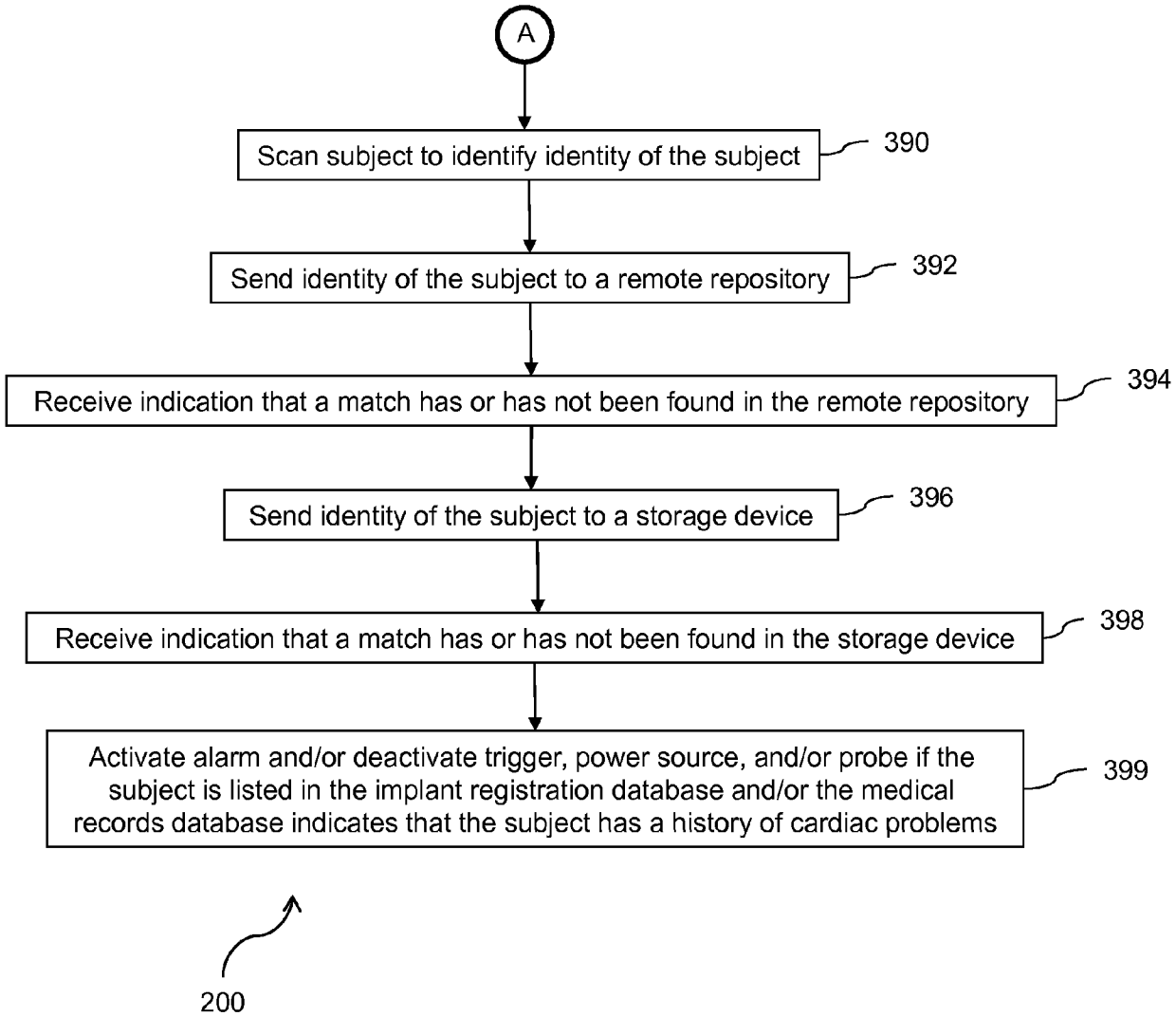

FIGS. 2A and 2B illustrate a flow diagram of a method of using a smart electroshock device according to an embodiment of the invention. A medical device sensor of the electroshock device is used to scan a subject for signals that are emitted from a medical device 310. If or when the medical device sensor of the electroshock device detects signals emitted from a medical device, an alarm of the electroshock device is activated and/or a trigger, a power source, and/or a probe of the electroshock device is deactivated 320. When the medical device sensor of the electroshock device does not detect signals emitted from a medical device, an indicator on the electroshock device is activated. Moreover, when the medical device sensor of the electroshock device does not detect signals emitted from a medical device electrical power is provided to the probe upon actuation of the trigger.

In addition, output from the medical device sensor (e.g., properties of the detected signal, such as frequency, amplitude, wavelength, and/or other signature characteristics) is sent to a remote repository 330, wherein the remote repository includes a database of signals produced by medical devices. An indication that a match has been found in the remote repository or an indication that a match has not been found in the remote repository is received 340. When a match has been found in the remote repository, the alarm of the electroshock device is activated and/or the trigger, the power source, and/or the probe of the electroshock device is deactivated 350.

In at least one embodiment, output from the medical device sensor is sent to a storage device of the electroshock device 360, wherein the storage device includes a database of signals produced by medical devices. An indication that a match has been found in the storage device or an indication that a match has not been found in the storage device is received 370. When a match has been found in the storage device, the alarm of the electroshock device is activated and/or the trigger, the power source, and/or the probe of the electroshock device is deactivated 380.

In addition, the subject is scanned with a biometric sensor to identify the identity of the subject 390. The identity of the subject (e.g., first name, surname, alias, social security number, and/or other personal identification number) is sent to a remote repository outside of the electroshock device 392, wherein the remote repository includes an implant registration database and/or a medical records database. An indication that a match has been found in the remote repository or an indication that a match has not been found in the remote repository is received 394. In at least one embodiment, the identity of the subject is sent to a storage device in the electroshock device 396, wherein the storage device includes an implant registration database and/or a medical records database. An indication that a match has been found in the storage device or an indication that a match has not been found in the storage device is received 398. When the subject is listed in the implant registration database and/or the medical records database indicates that the subject has a history of cardiac problems, the alarm of the electroshock device is activated and/or the trigger, the power source, and/or the probe of the electroshock device is deactivated 399.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute with the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Figure 3:
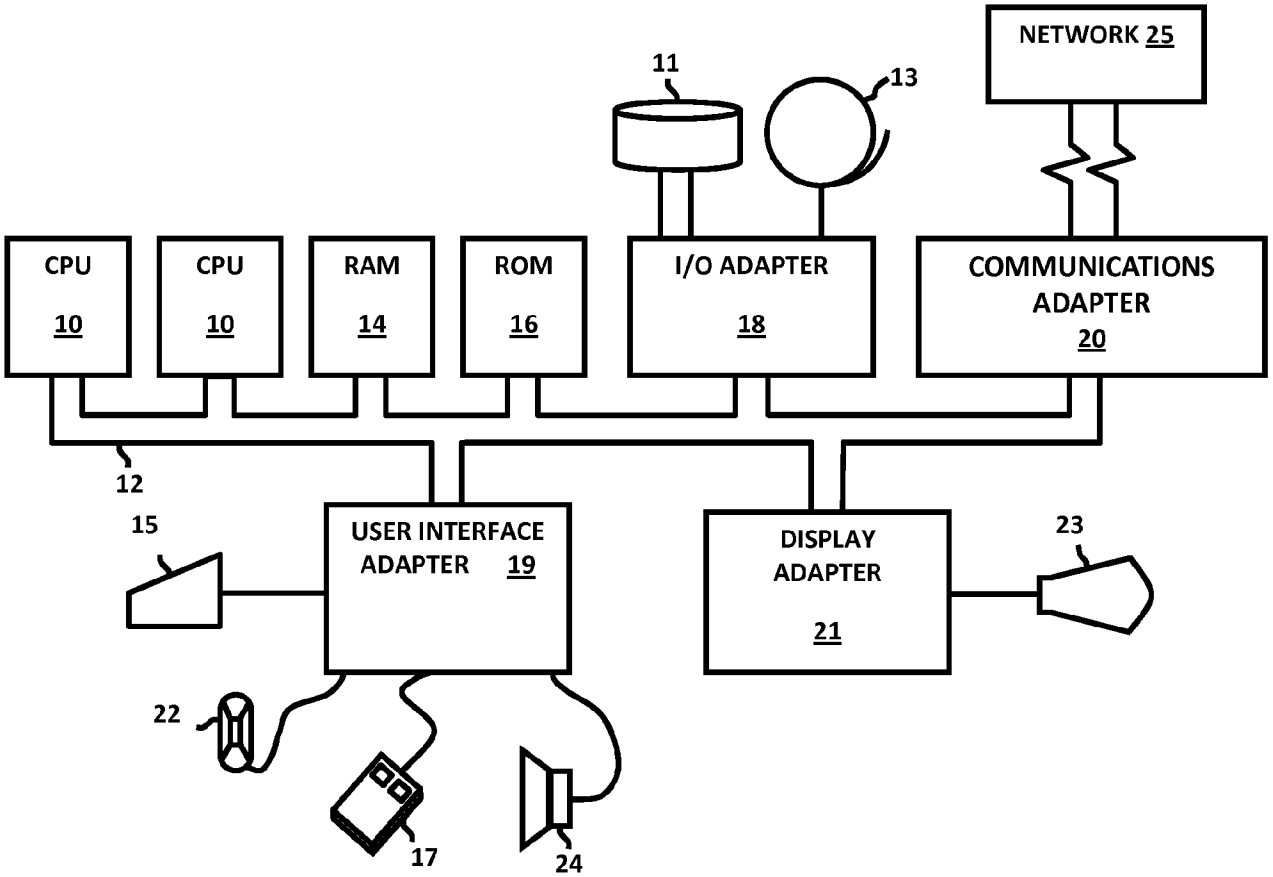
FIG. 3 illustrates a computer program product according to an embodiment of the invention.

Referring now to FIG. 3, a representative hardware environment for practicing at least one embodiment of the invention is depicted. This schematic drawing illustrates a hardware configuration of an information handling/computer system in accordance with at least one embodiment of the invention. The system comprises at least one processor or central processing unit (CPU) 10. The CPUs 10 are interconnected with system bus 12 to various devices such as a random access memory (RAM) 14, read-only memory (ROM) 16, and an input/output (I/O) adapter 18. The I/O adapter 18 can connect to peripheral devices, such as disk units 11 and tape drives 13, or other program storage devices that are readable by the system. The system can read the inventive instructions on the program storage devices and follow these instructions to execute the methodology of at least one embodiment of the invention. The system further includes a user interface adapter 19 that connects a keyboard 15, mouse 17, speaker 24, microphone 22, and/or other user interface devices such as a touch screen device (not shown) to the bus 12 to gather user input. Additionally, a communication adapter 20 connects the bus 12 to a data processing network 25, and a display adapter 21 connects the bus 12 to a display device 23 which may be embodied as an output device such as a monitor, printer, or transmitter, for example.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the root terms "include" and/or "have", when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means plus function elements in the claims below are intended to include any structure, or material, for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A device, comprising:

at least one probe for delivering an electrical shock to a subject when said probe is in physical contact with the subject;

a trigger connected to said probe;

a power source connected to said probe for providing electrical power to said probe upon actuation of said trigger;

a medical device sensor for detecting wireless signals emitted from an implanted medical device present in the subject, the implanted medical device including at least one of a pacemaker and a defibrillator;

an indicator connected to said medical device sensor, wherein said indicator provides at least one of an audio indication and a visual indication when said medical device sensor does not detect wireless signals emitted from an implanted medical device; and an override mechanism connected to said medical device sensor, wherein said override mechanism prevents actuation of said trigger when said medical device sensor detects the wireless signals emitted from the implanted medical device, said override mechanism deactivates said power source, said probe, and a propulsion mechanism.

2. The device according to claim 1, further including an alarm connected to said medical device sensor, wherein said alarm provides an audio alert and a visual alert when said medical device sensor detects the wireless signals emitted from the implanted medical device.

3. The device according to claim 1, further including a controller connected to said medical device sensor and an alarm, an override mechanism, and an indicator.

4. The device according to claim 1, further including:

a transmitter connected to said medical device sensor and a biometric sensor, wherein said transmitter sends one of output from said medical device sensor and output from said biometric sensor to a remote repository, the remote repository including a database of wireless signals produced by medical devices, an implant registration database, and a medical records database; and a receiver connected to a controller, wherein said receiver receives one of an indication that a match has been found in the remote repository and an indication that a match has not been found in the remote repository.

5. The device according to claim 1, further including a storage device connected to said medical device sensor, wherein said storage device includes a database of wireless signals produced by medical devices and an implant registration database.

6. The device according to claim 1, further including a biometric sensor connected to said medical device sensor, wherein said biometric sensor identifies an identity of the subject, and wherein said biometric sensor includes a facial recognition system, retinal scanner, and fingerprint scanner.

7. A device, comprising:

at least one probe for delivering an electrical shock to a subject when said probe is in physical contact with the subject;

a trigger connected to said probe;

a power source connected to said probe for providing electrical power to said probe upon actuation of said trigger; and a medical device sensor for detecting wireless signals emitted from a medical device present in the subject;

a controller connected to said medical device sensor and at least one of an alarm and an override mechanism, said alarm provides at least one of an audio alert and a visual alert when said medical device sensor detects the wireless signals emitted from the medical device, said override mechanism prevents actuation of said trigger when said medical device sensor detects the wireless signals emitted from the medical device, said override mechanism deactivates at least one of said power source, said probe, and a propulsion mechanism; and a biometric sensor connected to said controller, wherein said biometric sensor identifies an identity of the subject, and wherein said biometric sensor includes at least one of a facial recognition system, retinal scanner, and fingerprint scanner.

8. The device according to claim 7, further including:

a transmitter connected to said controller, wherein said transmitter sends at least one of output from said medical device sensor and output from a biometric sensor to a remote repository, the remote repository including at least one of a database of wireless signals produced by medical devices, an implant registration database, and a medical records database; and a receiver connected to said controller, wherein said receiver receives one of an indication that a match has been found in the remote repository and an indication that a match has not been found in the remote repository.

9. The device according to claim 7, further including a storage device connected to said controller, wherein said storage device includes at least one of a database of signals produced by medical devices and an implant registration database.

10. A system, comprising:

a device including:

at least one probe for delivering an electrical shock to a subject when said probe is in physical contact with the subject, and a medical device sensor for detecting wireless signals emitted from an implanted medical device, the implanted medical device including at least one of a pacemaker and a defibrillator;

a remote repository including at least one of a database of wireless signals produced by medical devices, an implant registration database, and a medical records database;

a transmitter connected to at least one of said medical device sensor and a biometric sensor, wherein said transmitter sends output from at least one of said medical device sensor and said biometric sensor to said remote repository; and a receiver connected to a controller, wherein said receiver receives one of an indication that a match has been found in the remote repository and an indication that a match has not been found in the remote repository.

11. The system according to claim 10, wherein said device further includes an alarm connected to said medical device sensor, and wherein said alarm provides at least one of an audio alert and a visual alert when said medical device sensor detects the wireless signals emitted from the implanted medical device.

12. The system according to claim 10, wherein said device further includes an override mechanism connected to said medical device sensor, and wherein said override mechanism prevents actuation of a trigger of said device when said medical device sensor detects the wireless signals emitted from the implanted medical device.

13. The system according to claim 10, wherein said device further includes a biometric sensor connected to said medical device sensor, wherein said biometric sensor identifies an identity of the subject, and wherein said biometric sensor includes at least one of a facial recognition system, retinal scanner, and fingerprint scanner.

14. A method for using an electroshock device, said method comprising:

scanning a subject for wireless signals emitted from an implanted medical device with a medical device sensor of the electroshock device; and when the medical device sensor of the electroshock device detects wireless signals emitted from an implanted medical device, at least one of:

activating an alarm of the electroshock device, the alarm providing at least one of an audio alert and a visual alert, and deactivating at least one of a trigger, a power source, and a probe of the electroshock device;

sending output from the medical device sensor to a storage device of the electroshock device, the storage device including a database of signals produced by medical devices; and receiving one of an indication that a match has been found in the storage device and an indication that a match has not been found in the storage device.

15. The method according to claim 14, further including providing electrical power to the probe upon actuation of the trigger when the medical device sensor of the electroshock device does not detect wireless signals emitted from an implanted medical device.

16. The method according to claim 14, further including:

sending output from the medical device sensor to a remote repository, the remote repository including a database of signals produced by medical devices; and receiving one of an indication that a match has been found in the remote repository and an indication that a match has not been found in the remote repository.

17. The method according to claim 14, further including:

scanning the subject with a biometric sensor to identify an identity of the subject; and when at least one of the subject is listed in an implant registration database and a medical records database indicates that the subject has a history of cardiac problems, at least one of:

activating the alarm of the electroshock device, and deactivating at least one of the trigger, the power source, and the probe of the electroshock device.

18. The method according to claim 14, further including activating an indicator on the electroshock device when the medical device sensor of the electroshock device does not detect signals emitted from a medical device.

19. The method according to claim 14, wherein said scanning a subject for signals emitted from a medical device is performed prior to providing electrical power to the probe.

20. The method according to claim 17, further including:

sending the identity of the subject to a remote repository outside of the electroshock device, the remote repository including at least one of the implant registration database and the medical records database; and receiving one of an indication that a match has been found in the remote repository and an indication that a match has not been found in the remote repository.

21. The method according to claim 17, further including:

sending the identity of the subject to a storage device in the electroshock device, the storage device including at least one of the implant registration database and the medical records database; and receiving one of an indication that a match has been found in the storage device and an indication that a match has not been found in the storage device.

* * * * *